US005533230A

United States Patent [19]

Rouda

[11] Patent Number: 5,533,230

[45] Date of Patent: Jul. 9, 1996

[54] VACUUM CLEANER ATTACHMENT FITTING

[75] Inventor: Dawn V. Rouda, Lancaster, Pa.

[73] Assignee: JMA & Associates, Inc., Indian Wells, Calif.

[21] Appl. No.: 450,308

[22] Filed: May 25, 1995

[51] Int. Cl.[6] ..... A47L 9/02

[52] U.S. Cl. ..... 15/339; 15/395; 15/414; 15/420

[58] Field of Search ..... 15/393, 395, 396, 15/420, 414, 339

[56] References Cited

U.S. PATENT DOCUMENTS

| | | | |
|---|---|---|---|
| 986,245 | 5/1915 | Thurman . | |
| 2,101,222 | 12/1937 | Mc Cracken | 15/398 |
| 2,624,061 | 1/1953 | Leas . | |
| 3,169,843 | 2/1965 | Campbell | 15/420 X |
| 3,244,437 | 4/1966 | Belicka et al. . | |
| 4,053,962 | 10/1977 | Mc Dowell | 15/414 X |
| 4,476,607 | 10/1984 | Ross | 15/339 |
| 4,694,529 | 9/1987 | Choiniere | 15/393 |

FOREIGN PATENT DOCUMENTS

| | | | |
|---|---|---|---|
| 511102 | 5/1955 | Canada . | |
| 642989 | 6/1962 | Canada . | |
| 104536 | 5/1942 | Sweden | 15/395 |
| 147346 | 10/1954 | Sweden | 15/395 |

*Primary Examiner*—Chris K. Moore
*Attorney, Agent, or Firm*—Alan R. Davis; Louis L. Dachs

[57] ABSTRACT

The invention is vacuum cleaner attachment for cleaning a surface within a confined space. In detail, the vacuum cleaner attachment fitting includes a first thin hollow rectangular member having a closed off first end and an open second end. A hollow tubular fitting is coupled to the second end for attaching to the vacuum hose of a vacuum cleaner. A second thin hollow rectangular member having open first and second ends, and top, bottom and side walls, is slidably engaged by its first end with the first end of the first member in a telescoping manner. The second end of the second member includes a plurality of vertical walls extending from the top wall to the bottom wall forming channels therebetween. The bottom wall is slotted between the vertical walls. Magnets are mounted on the side walls of the second member in proximity to the channels.

16 Claims, 3 Drawing Sheets

VACUUM CLEANER ATTACHMENT FITTING

BACKGROUND OF THE INVENTION

1. Field of the Invention

The invention relates to the field of vacuum cleaner attachments and, in particular, to an attachment fitting for cleaning surfaces under appliances and furniture where overhead space is very limited.

2. Description of Related Art

Because of their size and/or shape, it is next to impossible to vacuum clean under most appliances, such as refrigerators, or large pieces of furniture such as sofas, using conventional attachments. Thus special attachments have been developed over the years for such purposes. Of Particular interest is U.S. Pat. No. 2,624,061"Angular Adapter For Cleaning Tools" by E. Leas. Leas discloses a telescoping extension made of small round tubes instead of flat ones to reach under very low appliances and furniture. However, the use of round tubes limits the flow area, for if the circumference of the tubes, it access is limited and If the diameter is small their is little suction produced. U.S. Pat. No. 4,694,529 "Suction Device" by R. Choiniere discloses an attachment with a long hollow flat rectangular member having a flexible accordion section at a first end that is connected to a fitting adapted to couple to a vacuum line from a vacuum cleaner. The opposite or second end is closed off by a wall that incorporates a slit therein. An opening is included in the bottom wall of the member near the second end for picking up did from the floor. Protrusions on either end of the slot insure that an "air" space exists between the floor and the opening. However, its length makes storage difficult and it has no provisions for rotating the member relative to the vacuum line, which makes it difficult to use. Canadian patent numbers 511,102 "Vacuum Cleaner Attachment" and 642,989 "Vacuum Cleaner Attachment" by R. R. Derdall disclose thin flat rectangular members having openings on the bottom surface near one end, while U.S. Pat. No. 986,245 "Vacuum Cleaning Tool" by J. S. Thurman discloses a thin flat rectangular member with openings on one end and the bottom surface thereto. Finally, a problem that exits with all such fittings that have separate end and bottom pickups is the inability to pickup debris that overlaps both openings. What occurs is that it becomes "stuck" between the two openings or is not picked up at all. Also of interest is U.S. Pat. No. 3,244,437 "Adjustable Length Vacuum Cleaner Wand by M. E. Belicka, et al. Here the inventor has incorporated an adjustable length metal pipe segment in the vacuum cleaner hose. However, it is a round tube, instead of a flat blade like structure and is used for an entirely different purpose. It is cited for its incorporation of a manually adjust dénte system for adjusting the length of the pipe.

Thus, it is a primary object of the invention to provide an attachment fitting for a vacuum cleaner.

It is another primary object of the invention to provide an attachment fitting for a vacuum cleaner that can fit under appliances such as refrigerators and furniture such as sofas.

It is a further object of the invention to provide an attachment fitting for a vacuum cleaner that can fit under appliances such as refrigerators and furniture such as sofas, and also includes magnets for picking up metal items, such as hair pins and paper clips, preventing their ingestion into the vacuum cleaner.

It is a further object of the invention to provide an attachment fitting for a vacuum cleaner that can fit under appliances such as refrigerators and furniture such as sofas that incorporates a common opening in the end and bottom surface contiguous thereto so that the debris that overlaps both openings is picked up instead of being stuck" between the two openings or is not picked up.

SUMMARY OF THE INVENTION

The invention is vacuum cleaner attachment for cleaning a surface within a confined space. In detail, the vacuum cleaner attachment fitting includes a first thin hollow rectangular member having a closed off first end and an open second end. A hollow tubular fitting, having first and second portions joined at an obtuse angle, is rotatably mounted by one end to the first end of the first member. The second end of this fitting is adapted to attach to the vacuum hose of a vacuum cleaner. Preferably, the fitting is rotatably mounted to the first end of the first member having an axis of rotation aligned with the longitudinal axis thereof.

A second thin hollow rectangular member having open first and second ends, and top, bottom and side walls, is slidably engaged in a telescoping manner by it's first end with the second end of the first member. A sealing member is mounted on the first end of the second member for preventing air from being drawn in between the internal wall of the first member and the first end of the second member. The second end of the second member includes a plurality of vertical walls extending from the top wall to the bottom wall forming channels therebetween and with the side walls. The bottom wall is slotted between the vertical walls. The second end is chamfered back from one side toward the first end. Preferably, at least one protrusion is mounted on the bottom wall of the second member positioned for spacing the second end of the second member above the surface when the attachment fitting is inserted in the confined space. Magnets are mounted on the side walls of the second member in proximity to the channels.

The advantage of the subject invention over the prior art attachment fittings for cleaning a surface within a confined space is that having the telescoping members allows the attachment fitting to be stored in a relatively small space. The magnets help prevent the ingestion of harmful metal materials. The swivelly mounted tubular fitting on the first member allows the vacuum cleaner hose attached thereto to swing in an arc about the longitudinal axis of the first and second members making it much easier to position it to an optimal position for vacuuming. Additionally, the incorporation of a slotted opening at the chamfered second end of the second member as well as having a contiguous opening on the bottom wall of thereof allows simultaneous pickup of material that over laps the second end.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

Figure 1:
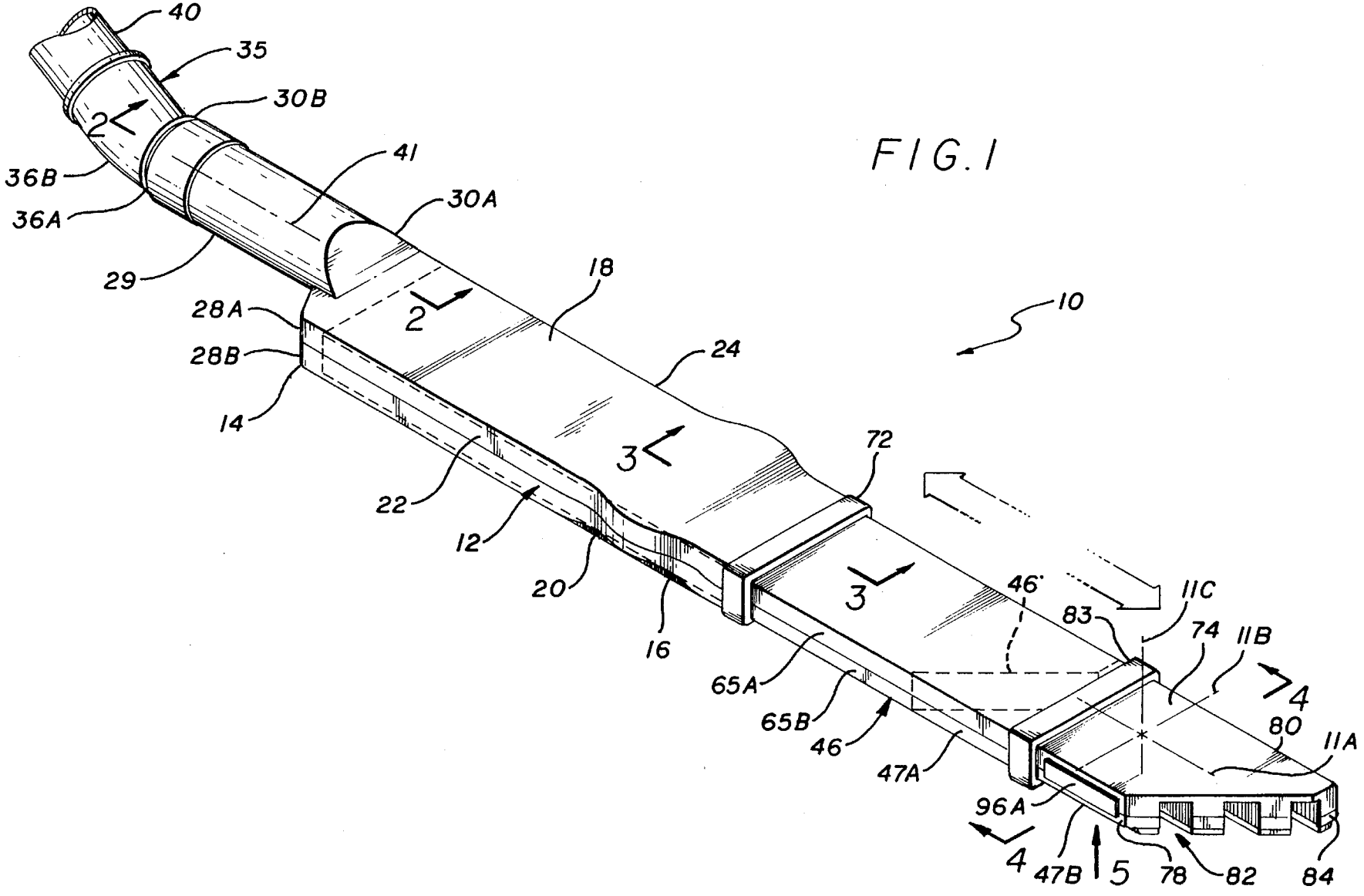
FIG. 1 is a perspective view of the attachment fitting illustrating the fitting in the extended position in solid lines and the collapsed position for storage in dotted lines.
Figure 2:
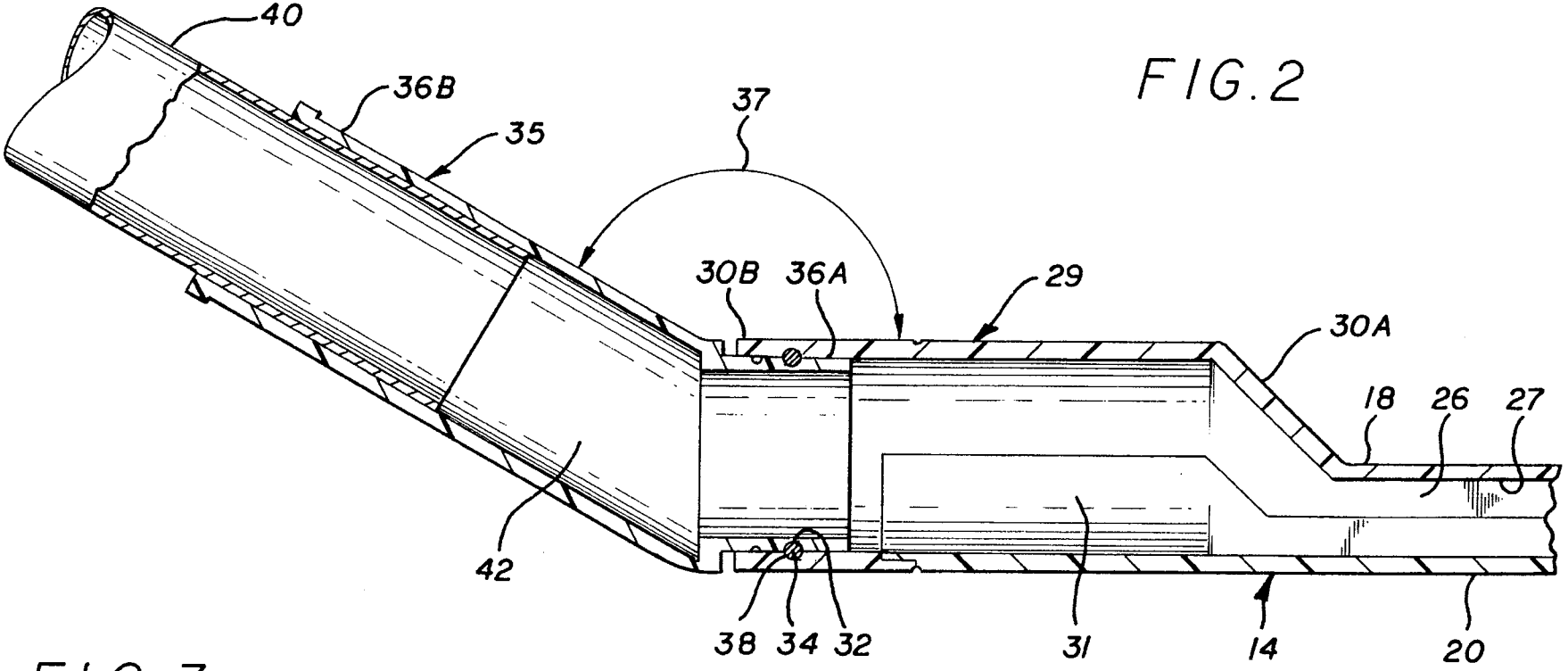
FIG. 2 is a partial cross-sectional view of the attachment fitting shown in FIG. 1 taken along the line 2—2.
Figure 3:
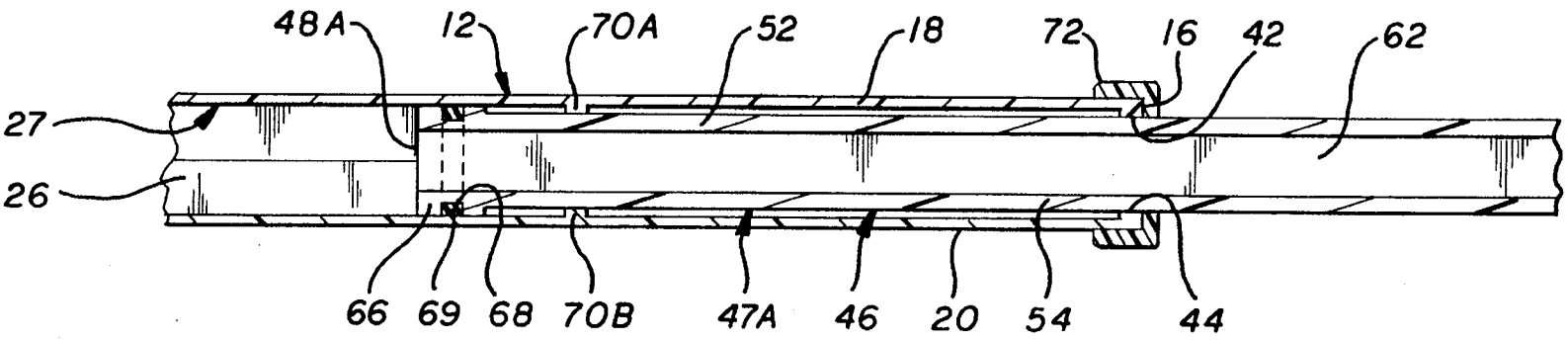
FIG. 3 is a partial cross-sectional view of the attachment fitting shown in FIG. 1 taken along the line 3—3.

Referring to FIGS. 1 through 3, the attachment fitting, generally indicated by numeral 10, includes a longitudinal axis 11A, lateral axis 11B and a vertical axis 11C. The fitting further includes a hollow rectangular shaped first member 12 having a closed off first end 14 and an open second end 16, top wall 18, bottom wall 20, and side walls 22 and 24. The hollow interior indicated by numeral 26, is rectangular shaped with the internal peripheral surface indicated by numeral 27. Preferably, the housing is made of upper and lower halves 28A and 28B, respectively held together by fasteners (not shown) for purposes of manufacture.

A hollow tubular member 29, having first and second ends 30A and 30B, respectively, is mounted by its first end 30A to the end 14 of the first member 12 in parallel alignment with the longitudinal axis 11A of the fitting 12 and includes a circular internal passageway 31 in communication with the interior 26 of the first member 12. The member 29 includes a circumferential groove 32 near the second end 30B in which is mounted a retaining ring 34. A hollow tubular member 35, having first and second portions 36A and 36B, respectively, joined at an obtuse angle 37, is rotatably mounted by portion 36A to the second end 30B of the fitting 29. Mounting is accomplished by means of a groove 38 that is aligned with groove 32 in the fitting 29 such that retaining ring 34 extends there into. The second portion 36B is adapted to attach to a vacuum hose 40 of a vacuum cleaner (not shown). Preferably, the member is rotatably mounted with an axis of rotation 41 offset but aligned with the longitudinal axis 11A of the fitting 10. A passageway 42 extends though the hollow tubular member 35, thus connecting the vacuum hose 40 to the interior 26 of the first member 12 via the passageway 31.

Referring to FIGS. 1 and 3, the second or open end 16 of the first member 12 includes small lip like members 42 and 44 that extend inwardly from both the top and bottom walls 18 and 20, respectively. A second thin hollow tubular member 46 is included having first and second sections 47A and 47B. The first section 47A includes open first and second ends 48A and 48B, a top wall 52, bottom wall 54 and side walls 56 and 60 with the interior indicated by numeral 62. The section 47A is also made from two halves 65A and 65B joined together by fasteners (not shown). The first end 48 includes an enlarged portion 66 that is slightly smaller than the internal periphery 27 of the first member 12. Thus portion 66 of the first end 48 of the section 47A slidably engages the internal surface 27 of the second end 16 of the first member 12 while the top and bottom walls 56 and 58 of the section 47A are supported by the lip like members 42 and 44 at the second end 16 of the first member 12. The flange 66 includes a peripheral groove 68 containing a semi-flexible seal 68, thus sealing off the interior of the first and second members so that air can not enter when a vacuum is "pulled."

Thus the second member 46 can telescope in or out of the first member 12 (the collapsed portion is indicated in dotted lines and number 46'). However, it can not completely leave the first member 12 because it is retrained by internal protrusions 70A and 70B on the top and bottom walls 18 and 20 of the first tubular member 12 at some distance from the second end 16. This also provides firm support when the second member 46 is extended as shown in FIGS. 1 and 3. Finally, a cap 72 is press fit over the end 16 of the first member 12 to provide a clamp further holding the member halves 29A and 29B together as well as prevent dust and the like from entering the interior 26 of the first member 12. Furthermore, the cap 72 is used to maintain the bottom surfaces 20 and 54 of the first member 12 and section 47A of the second member 46, respectively, slightly spaced above the surface to be cleaned.

Figure 4:
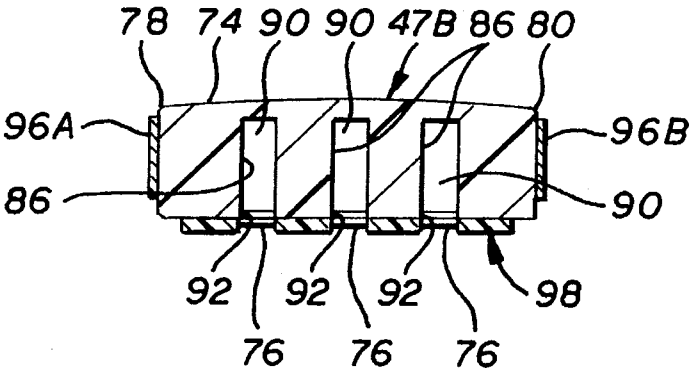
FIG. 4 is a partial cross-sectional view of the attachment fitting shown in FIG. 1 taken along the line 4—4.
Figure 5:
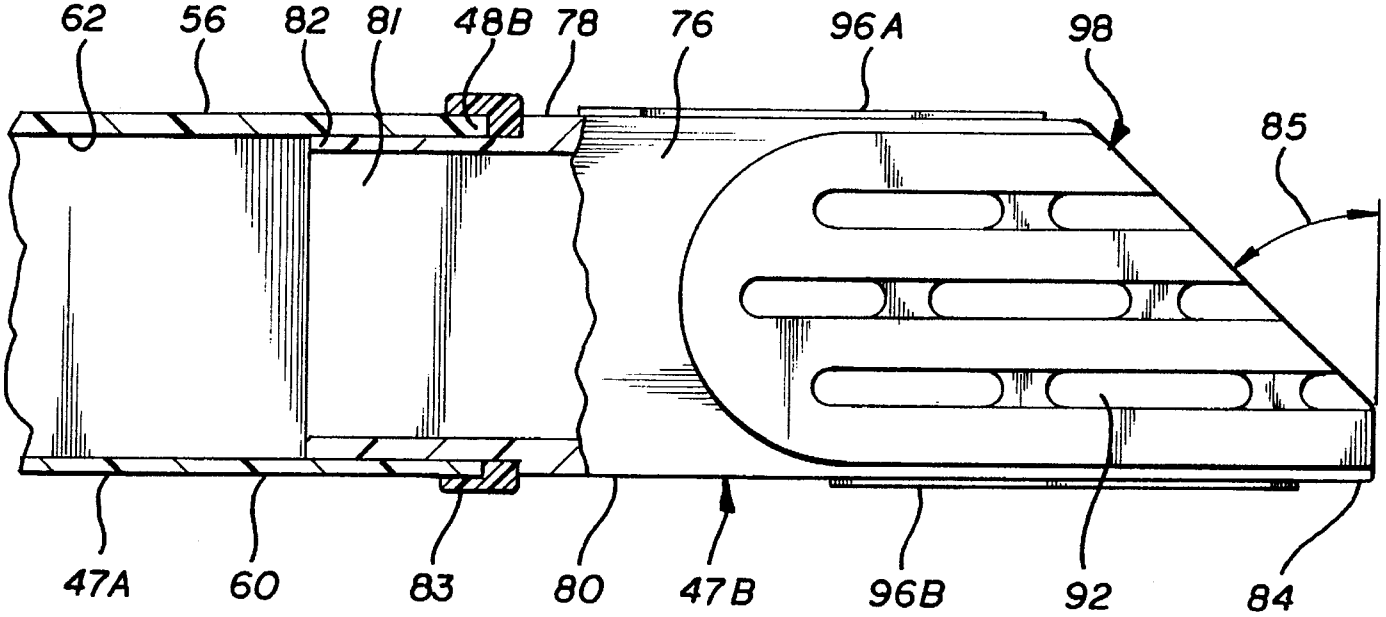
FIG. 5 is a partial bottom view of the attachment fitting shown in FIG. 1 taken along the arrow 5.

Referring now to FIGS. 1, 4 and 5, it can be seen that the second section 47B of the second member 46 is also hollow and rectangular shaped having top and bottom walls 74 and 76 and side walls 78 and 80 with the interior indicated by numeral 81. The first end 82 is open and is necked down and adapted to slidalbly fit within the interior 62 at the second end 48B of the first portion 47A. A cap 83 is positioned over the end 48B of the first section 47A that further secures the halves 65A and 65B of the second section and, additionally, maintains the second section 47B slightly above the surface to be cleaned. The open second end 84 is chamfered back at and angle 85, which is preferably 45 degrees. A plurality of internal vertical partitions or walls 86 extend from the top wall 74 to the bottom wall 76 of forming a plurality of internal passageways or channels 90 between each other and the side walls 78 and 80. The bottom surface 76 incorporates a plurality of slots 92 aligned with the passageways 90, thus providing an opening on both the end 84 and bottom wall 76 that are contiguous and which are in communication with the interior 81 of the second section 47B.

Thin flat magnets 96A and 96B are attached to the side walls 78 and 80 of the second section 47B of the second member 46 in proximity to the channels 90. This insures that most metal items such as hair pins and paper clips are "picked up" prior to ingestion into the interior of attachment fitting. Finally, a slotted wear pad 98 is joined to the bottom surface 76. While the magnets will not be effective non metals that are not magnetically attractive, the above mentioned hair pins and paper clips are, and are the most likely to be encountered.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the vacuum cleaner industry.

I claim:

1. A vacuum cleaner attachment fitting for cleaning a surface within a confined space, said attachment fitting comprising:

a first thin hollow rectangular member having a closed off first end and an open first end;

a hollow tubular fitting coupled to said first end for attaching to the vacuum hose of a vacuum cleaner;

a second thin hollow rectangular member having open first and second ends, and top, bottom and side walls, said first end of said second member slidably engaged with said second end of said first member in a telescoping manner, said second end of said second member having a plurality of vertical walls extending from said top wall to said bottom wall forming channels therebetween, said bottom wall slotted between said vertical walls.

2. The attachment fitting as set forth in claim 1 wherein said second end of said second member is chamfered back from one side wall toward said first end.

3. The attachment as set forth in claim 2 further including magnets mounted on said side walls of said second member in proximity to said channels.

4. The attachment fitting as set forth in claim 3 comprising said hollow tubular member swivelly coupled to said first member.

5. The attachment as set forth in claim 4 further including at least one protrusion mounted on said bottom wall of said second member positioned for spacing said bottom wall of said second member above the surface when the attachment is inserted in the confined space.

6. The attachment fitting as set forth in claim 5 further including said hollow tubular member having an axis of rotation aligned with said first member.

7. The attachment fitting as set forth in claim 6 wherein said second end of said second member is chamfered at a generally 45 degree angle.

8. The attachment fitting as set forth in claim 6 comprising:

a hollow tubular fitting offset but parallel with said first member, having first and second ends, said first end thereof attached to said second end of said first tubular member;

said fitting includes first and second portions joined together at an obtuse angle forming an elbow, said first end of said hollow tubular member rotatably mounted to said second end of said hollow tubular fitting.

9. A vacuum cleaner attachment fitting for cleaning a surface within a confined space, said attachment fitting comprising:

a first thin hollow rectangular member having a closed off first end and an open second end;

a hollow tubular fitting coupled to said second end for attaching to the vacuum hose of a vacuum cleaner;

a second thin hollow rectangular member having open first and second ends, and top, bottom and side walls, said first end of said second member slidably engaged with said second end of said first member in a telescoping manner, said second end of said second member having an opening on the bottom wall contiguous with the open second end of said second member, said second end of said second member having a plurality of vertical walls extending from said top wall to said bottom wall forming channels therebetween, said opening in said bottom wall comprises slots between said vertical walls.

10. The attachment fitting as set forth in claim 9 wherein said second end of said second member is chamfered back from one side wall toward said first end.

11. The attachment as set forth in claim 10 further including magnets mounted on said side walls of said second member in proximity to channels.

12. The attachment fitting as set forth in claim 11 comprising said hollow tubular member swivelly coupled to said first member.

13. The attachment as set forth in claim 12 further including at least one protrusion mounted on said bottom wall of said second member positioned for spacing the bottom wall of said second member above the surface when the attachment is inserted in the confined space.

14. The attachment fitting as set forth in claim 13 further including said hollow tubular member having an axis of rotation aligned with said first member.

15. The attachment fitting as set forth in claim 14 wherein said second end of said second member is chamfered at a generally 45 degree angle.

16. The attachment fitting as set forth in claim 14 comprising:

a hollow tubular fitting offset but parallel with said first member, having first and second ends, said first end thereof attached to said second end of said first tubular member;

said fitting includes first and second portions joined together at an obtuse angle forming an elbow, said first end of said hollow tubular member rotatably mounted to said second end of said hollow tubular fitting.

* * * * *